US007866198B2

(12) United States Patent
Chilson et al.

(10) Patent No.: US 7,866,198 B2
(45) Date of Patent: Jan. 11, 2011

(54) METHOD OF PRODUCING A STEPPED SHAFT

(75) Inventors: Terry R Chilson, East Rochester, OH (US); Mahaveer P Khetawat, Sterling Heights, MI (US); John A Pale, Troy, MI (US)

(73) Assignee: American Axle & Manufacturing, Inc., Detroit, MI (US)

( * ) Notice: Subject to any disclaimer, the term of this patent is extended or adjusted under 35 U.S.C. 154(b) by 365 days.

(21) Appl. No.: 12/055,389

(22) Filed: Mar. 26, 2008

(65) Prior Publication Data

US 2009/0241629 A1 Oct. 1, 2009

(51) Int. Cl.
*B21D 22/00* (2006.01)

(52) U.S. Cl. ..... 72/356; 72/108; 72/352

(58) Field of Classification Search ..... 72/71, 72/102, 103, 104, 105, 107, 108, 110, 111, 72/352, 358, 76, 356
See application file for complete search history.

(56) References Cited

U.S. PATENT DOCUMENTS

| | | | | | |
|---|---|---|---|---|---|
| 470,354 | A | * | 3/1892 | Slick | 72/107 |
| 504,888 | A | * | 9/1893 | Nessel et al. | 301/110.5 |
| 2,342,917 | A | * | 2/1944 | Brown | 86/54 |
| 2,599,575 | A | | 6/1952 | Morgan | |
| 3,024,626 | A | | 3/1962 | Frischman | |
| 3,208,257 | A | * | 9/1965 | Jiri | 72/108 |
| 3,277,684 | A | * | 10/1966 | Gareri | 72/105 |
| 3,503,237 | A | * | 3/1970 | Marcovitch | 72/80 |
| 3,631,585 | A | | 1/1972 | Stamm | |
| 3,643,486 | A | | 2/1972 | Hladky | |
| 3,663,977 | A | * | 5/1972 | Marcovitch | 470/11 |
| 4,065,948 | A | * | 1/1978 | Tsukamoto et al. | 72/108 |
| 4,087,038 | A | | 5/1978 | Yagi | |
| 4,206,623 | A | | 6/1980 | Kovar et al. | |
| 4,213,351 | A | | 7/1980 | Rowlinson | |
| 4,435,973 | A | * | 3/1984 | Nakazawa et al. | 72/327 |
| 4,489,581 | A | * | 12/1984 | Davidovich et al. | 72/70 |
| 4,523,445 | A | * | 6/1985 | Yoshida | 72/69 |
| 4,644,772 | A | * | 2/1987 | Killop et al. | 72/88 |

(Continued)

FOREIGN PATENT DOCUMENTS

| | | |
|---|---|---|
| JP | 55-158809 | * 12/1980 |

(Continued)

OTHER PUBLICATIONS

Gontarz, et al.; "Head forging aspects of new forming process of screw spike"; Journal of Materials Processing Technology; 153-154 (2004); pp. 736-740.

*Primary Examiner*—Edward Tolan
(74) *Attorney, Agent, or Firm*—Harness, Dickey & Pierce, P.L.C.

(57) ABSTRACT

A method for forming a stepped shaft includes: forming a billet of a predetermined mass; heating the billet; cross-wedge rolling the billet to form an intermediate workpiece having a first cylindrical portion and a second cylindrical portion that are axially spaced apart by a neck that is smaller in diameter than the first and second cylindrical portions; and performing at least one upset forging operation on the end of the intermediate workpiece to enlarge the first cylindrical portion such that in at least one location its diameter is larger than a diameter of any other portion of the stepped shaft and larger than a diameter of the billet.

17 Claims, 5 Drawing Sheets

U.S. PATENT DOCUMENTS 4,722,211 A * 2/1988 Tsukamoto et al. ..... 72/70
4,811,585 A * 3/1989 Takahashi et al. ..... 72/108
4,998,344 A * 3/1991 Hsieh ..... 29/894.362
5,205,464 A 4/1993 Simon
5,213,250 A 5/1993 Simon
5,632,684 A 5/1997 Kumar et al.
6,059,378 A 5/2000 Dougherty et al.
6,065,813 A 5/2000 Fett et al.
6,572,199 B1 6/2003 Creek et al.
6,698,078 B2 3/2004 Prucher
2006/0183561 A1 8/2006 Briggs
2006/0273672 A1* 12/2006 Inoue et al. ..... 310/83

FOREIGN PATENT DOCUMENTS

JP 57-32839 * 2/1982
JP 59-197334 * 11/1984
JP 60-118347 A 6/1985
JP 61-216827 A 9/1986
JP 2000-326043 A 11/2000

* cited by examiner

METHOD OF PRODUCING A STEPPED SHAFT

INTRODUCTION

The present invention generally relates the forging of shafts and more particularly to the forging of a stepped shaft through a combination of forging operations.

It is known in the art to forge stepped shafts using either cross wedge rolling or upset forging. Such stepped shafts can be employed in various different applications, including transmission shafts and can be processed in one or more subsequent machining operations so that a longitudinal bore extends through the shaft. Cross wedge rolling is a process that involves the use of wedge-shaped tools between which a cylindrical billet is rolled, whereas upsetting employs a ram to displace material into a cavity in a die.

An exemplary cross wedge rolling process is illustrated in FIG. 6 in which a tooling set 100 is employed to forge a billet 102 into a stepped shaft 104. The stepped shaft 104 includes a first portion 106, a second portion 108 and a neck 110. The first and second cylindrical portions 106 have a diameter that is relatively larger than the diameter of the neck 110. The diameter of the first portion 108 is roughly equal to the diameter of the billet 102.

The tooling set 100 can include a top tool 120 and a bottom tool 122. The top and bottom tools 120 and 122 can be either round or flat depending upon the particular type of cross wedge forging machine that is employed. As the top and bottom tools 120 and 122 can be generally identical in construction, a discussion of the bottom tool 122 will suffice for both. The bottom tool 122 can include a base portion 130 and a contoured forming portion 132 that is configured to form the neck 110 when the billet 102 is rolled between the top and bottom tools 120 and 122.

As cross wedge rolling is employed to simultaneously elongate and reduce the diameter of the billet 102, it will be appreciated that the billet 102 must have a diameter that is slightly greater than or equal to the diameter of the largest portion of the stepped shaft 104 (i.e., the diameter of the first and second cylindrical portions 106 and 108). In situations where the differences in the several diameters of the stepped shaft 104 are relatively large, the billet 102 must undergo an excessive amount of deformation, which can require longer, more complex tools as the maximum amount of deformation or reduction is determined by certain rules applicable to the cross wedge rolling process. Further, cross-wedge rolling cannot impart any axial holes or impressions at the ends of the stepped shaft 110.

An exemplary manufacturing process is illustrated in FIG. 7 which employs upset forging to form a stepped shaft 210. The upset forging operation is performed with a tooling set 200 having a fixed die 220 and a moving die 222 that cooperate to define a cavity 224. The cavity 224 can have a diameter that corresponds to a diameter of the largest portion of the stepped shaft 210. A billet (not shown) of a relatively smaller diameter can be introduced to the cavity 224 and one end of the billet can extend from a side of the tooling set 200. A ram 230 is pressed against the end of the billet to drive the end into the cavity 224 to thereby fill the cavity 224 to form the portion of the stepped shaft 210. If the diameter of the cavity 224 is large in comparison to the stepped shaft 210, multiple progressive upsets may be required to prevent or limit buckling of the stock that forms the shaft 210.

In situations where upset forging is employed in the formation of a stepped shaft having two cylindrical portions that are spaced apart by a neck, it is frequently necessary to machine the neck. Those of skill in the art will appreciate that such machining steps are not desirable as they are relatively costly and generate waste metal chips.

SUMMARY

In one form, the present teachings provide a method for forming a stepped shaft. The method includes: providing a billet of a predetermined mass; heating the billet; cross-wedge rolling the billet to form an intermediate workpiece having a first cylindrical portion and a second cylindrical portion that are axially spaced apart by a neck that is smaller in diameter than the first and second cylindrical portions; and performing at least one upset forging operation on the end of the intermediate workpiece to enlarge the first cylindrical portion such that in at least one location its diameter is larger than a diameter of any other portion of the stepped shaft and larger than a diameter of the billet.

In another form, the present teachings provide a method for forming a stepped shaft. The method includes: providing a billet of a predetermined mass; heating the billet; rolling the billet to reduce a diameter of the billet in at least two areas to form at least three zones, each of the zones having a diameter that is different from any adjacent zone or zones; upset forging a first one of the zones to form a first portion of the stepped shaft, the first one of the zones being enlarged in diameter and reduced in length such that a diameter of the first portion of the stepped shaft is greater than a diameter of the billet; wherein a second one of the zones is disposed between the first portion of the stepped shaft and a third one of the zones and wherein a diameter of the second one of the zones is smaller than a diameter of a third one of the zones.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
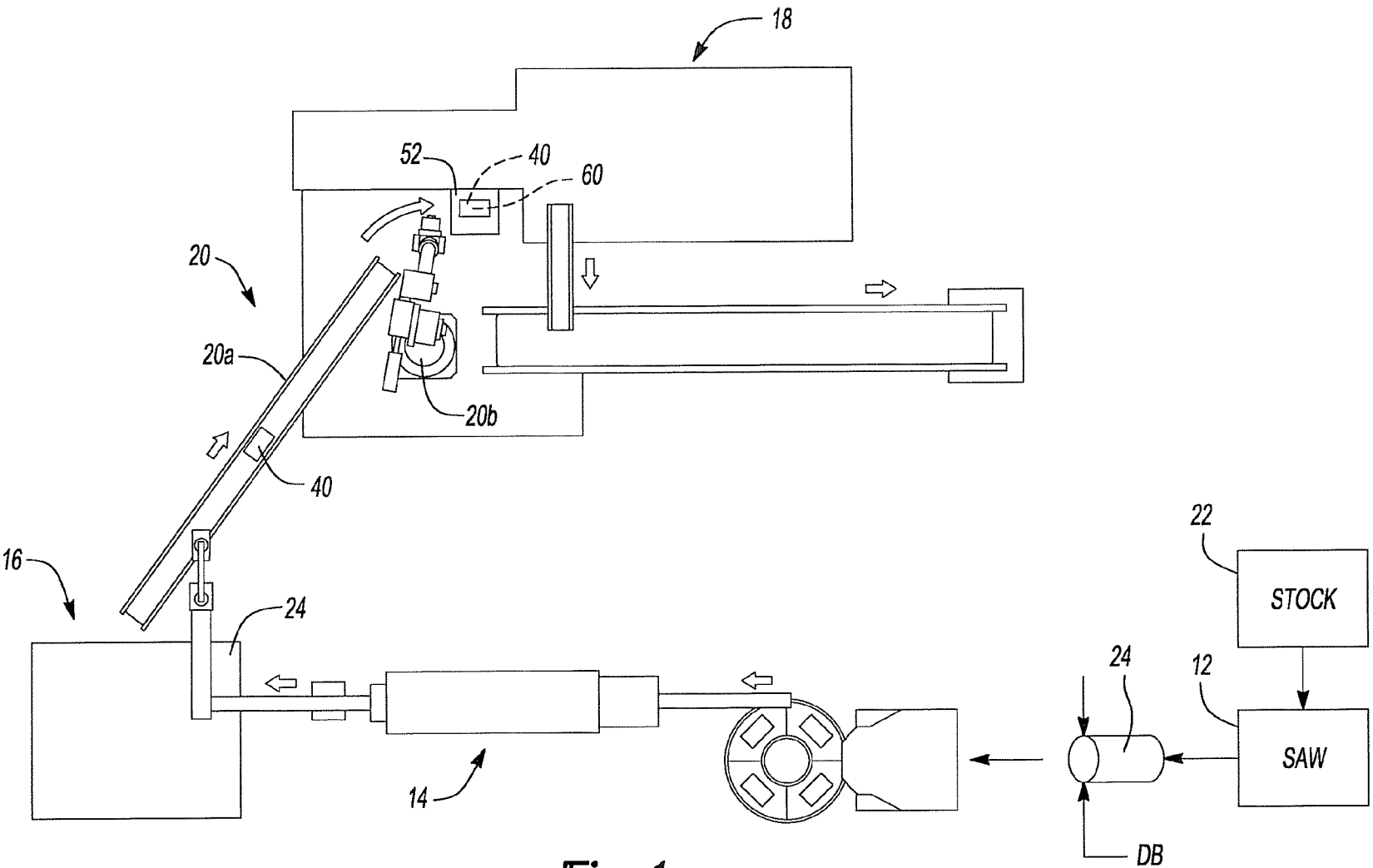
FIG. 1 is a top plan view of a fabricating system for producing stepped shafts constructed in accordance with the teachings of the present disclosure.

With reference to FIG. 1, a fabricating system for forming a stepped shaft in accordance with the teachings of the present disclosure is generally indicated by reference numeral 10. The fabricating system 10 can include a cut-off saw 12, a heater 14, a cross-wedge rolling machine 16, one or more upset forging machines 18 and a conveyance system 20 for conveying workpieces from the cross-wedge rolling machine 16 to the upset forging machine(s) 18. In the particular example provided, the fabricating system 10 includes a single upset forging machine 18 with a multi-stage die set, while the conveyance system 20 includes a conveyor 20*a*, a pick-and-place robot 20*b*. Those of skill in the art will appreciate that the conveyance system 20 can include any type of conveyance means, including gantry robots and indexing tables. As such, it is understood that the disclosure and appended claims are not limited in any way by the particular conveyance means illustrated and described herein.

Figure 2:
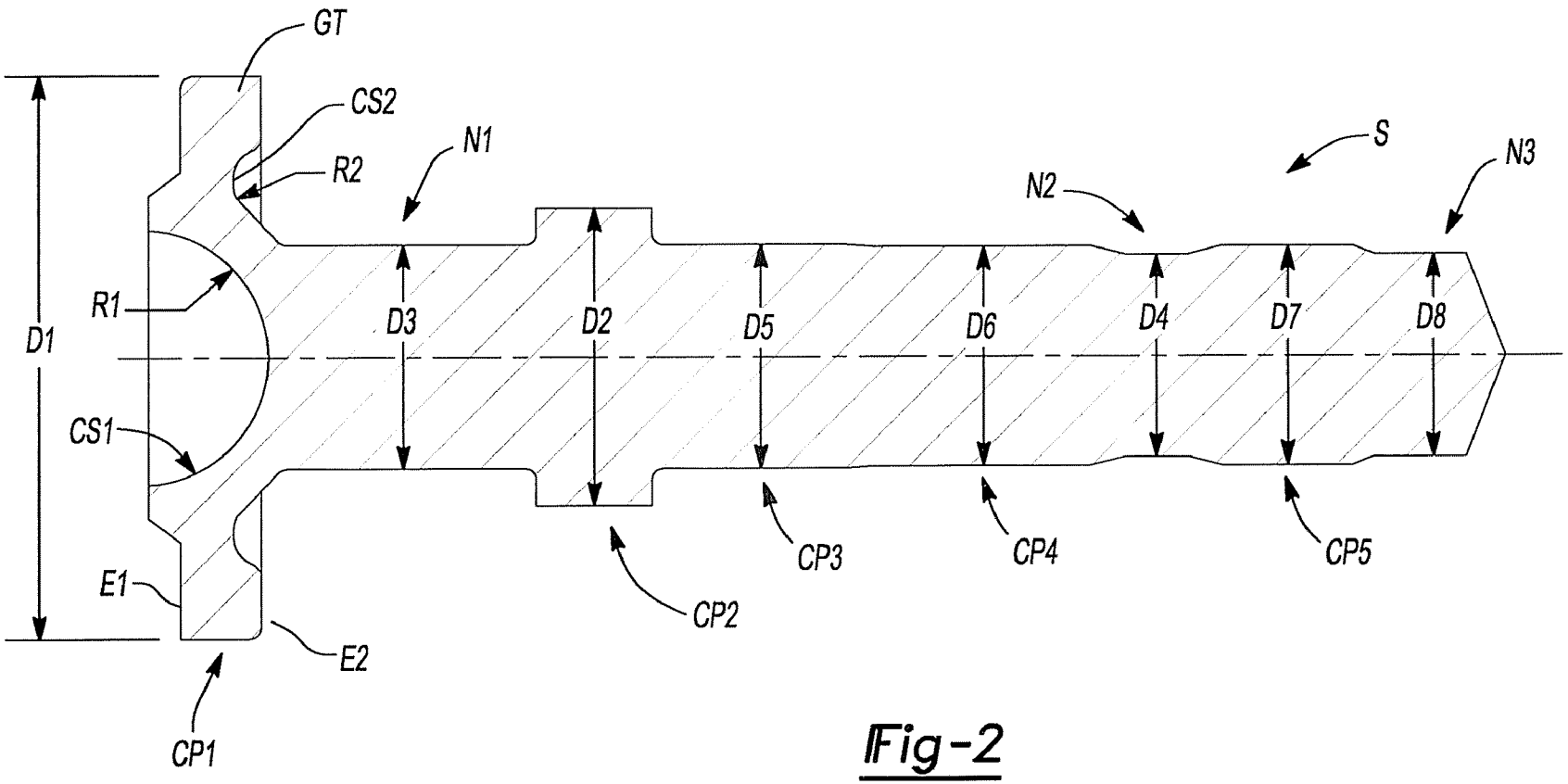
FIG. 2 is a longitudinal sectional view of an exemplary stepped shaft.

An exemplary stepped shaft S formed in accordance with the teachings of the present disclosure is illustrated in FIG. 2. The stepped shaft S can include a first cylindrical portion CP1, a second cylindrical portion CP2, a first neck N1 and a second neck N2. The first cylindrical portion CP1 has a diameter D1 that is relatively larger than the diameter D2 of the second cylindrical portion CP2. The first neck N1 is disposed between the first and second cylindrical portions CP1 and CP2 and has a diameter D3 that is smaller than the diameter D2 of the second cylindrical portion CP2. The second neck N2 can be disposed on a side of the second cylindrical portion CP2 opposite the first neck N1 and has a diameter D4 that can be the same or different (e.g., smaller) than the diameter D3 of the first neck N1 and smaller than the diameter D2 of the second cylindrical portion CP2. It will be appreciated that the stepped shaft S can be configured with a geometry that differs from that which is expressly described above. For example, and for purposes of illustration only, the stepped shaft S is illustrated in FIG. 2 to include a third cylindrical portion CP3 with a fifth diameter D5, a fourth cylindrical portion CP4 with a sixth diameter D6, a fifth cylindrical portion CP5 with a seventh diameter D7 and a third neck N3 with an eighth diameter D8. The third and fourth cylindrical portions CP3 and CP4 can be disposed between the second neck N2 and the second cylindrical portion CP2. The second neck N2 can be disposed between the fourth cylindrical portion CP4 and the fifth cylindrical portion CP5. The third neck N3 can be disposed on a side of the fifth cylindrical portion CP5 opposite the second neck N2.

Referring now to FIGS. 1 and 2, the cut-off saw 12 is employed to cut a cylindrical stock material 22 into billets 24. The cylindrical stock material 22 can have a diameter DB that is equal to or slightly larger than the diameter D2 of the second cylindrical portion CP2 of the stepped shaft S. Stated another way, the diameter DB of the cylindrical stock material 22 can be nearly equal to the diameter of the largest cylindrical portion of the intermediate shaft 40. In the example provided, the diameter DB of the cylindrical stock material 22 is 56.0 mm, while the diameter D2 of the second cylindrical portion CP2 is 55.9 mm. The length of the billet 24 is chosen so that the mass of the billet 24 is equal to the mass of the stepped shaft S. Those of skill in the art will appreciate that two workpieces can be processed simultaneously in the cross-wedge rolling machine 16 and as such, the length of the billet 24 in such case is chosen so that the mass of the billet 24 is equal to twice the mass of the stepped shaft S.

The billets 24 can be processed through the heater 14 to raise the temperature of the billets 24 to an appropriate forging temperature, such as between about 1200° F. to about 2300° F. Preferably, the heater heats the billets 24 to a temperature between about 2000° F. to about 2300° F., and more preferably to a temperature of about 2250° F. Any suitable heater can be employed, such as an induction heater.

Figure 3:
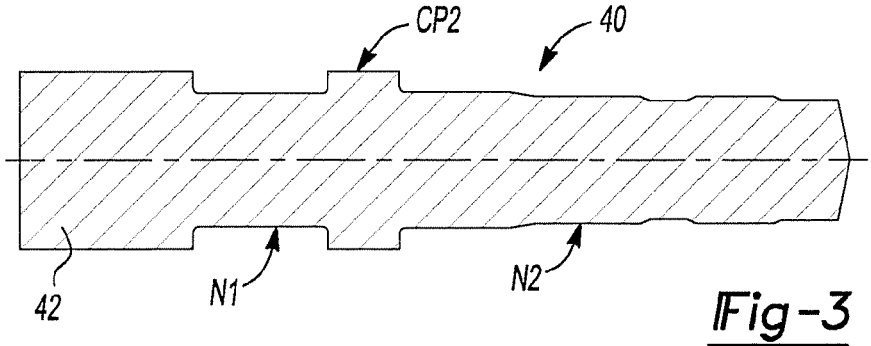
FIG. 3 is a front elevation view of a first intermediate workpiece constructed during the formation of the stepped shaft of FIG. 2 utilizing a forming method in accordance with the teachings of the present disclosure.

The heated billets 24 can be introduced to the cross-wedge rolling machine 16 to produce a first intermediate workpiece 40, an example of which is shown in FIG. 3. In the example provided, the second cylindrical portion CP2, the first neck N1 and the second neck N2 are formed to size but the end 42 of the first intermediate workpiece 40 that corresponds to the location of the first cylindrical portion CP1 is relatively longer and smaller in diameter than the first cylindrical portion CP1 so that they are roughly equal in volume. It will be appreciated that if the billets 24 were sized to fabricate two or more of the stepped shafts S, the tooling set (not specifically shown) of the cross-wedge rolling machine 16 could be configured to form the two or more first intermediate workpieces 40 and simultaneously separate them from one another.

Figure 4:
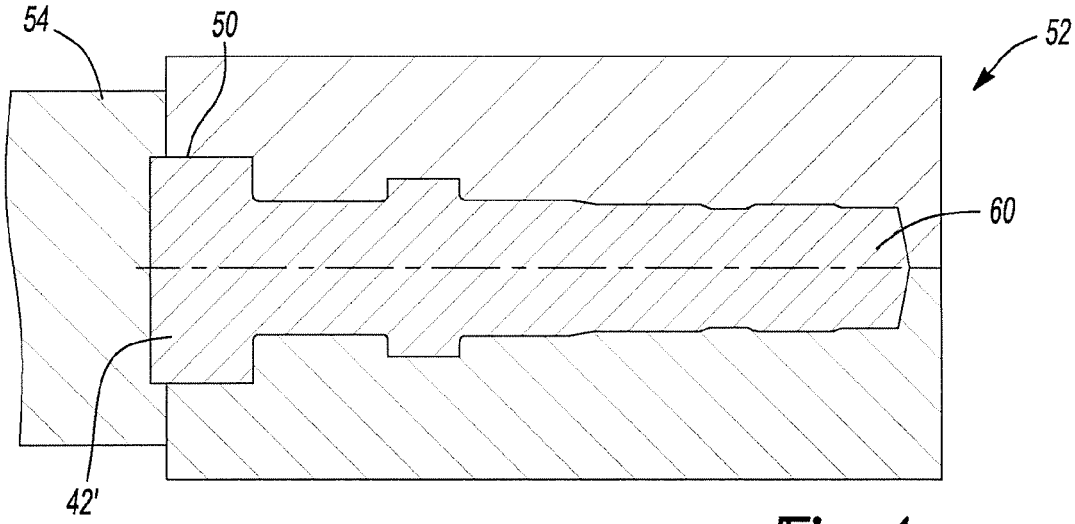
FIG. 4 is a section view taken through a first upset forging tool and a second intermediate workpiece constructed during the formation of the stepped shaft of FIG. 2 utilizing a forming method in accordance with the teachings of the present disclosure.

With reference to FIGS. 1 and 4, the first intermediate workpieces 40 can be transported by the conveyance system 20 to the upset forging machine 18 and placed into a first cavity or pass 50 in a tooling set 52. If the cycle times are relatively short, the first intermediate workpiece 40 can be loaded directly into the tooling set 52 without re-heating the material that forms the first intermediate workpiece 40. A portion of the end 42 (FIG. 3) of the first intermediate workpiece 40 can extend from the tooling set 52 and a first ram 54 can be pressed against the end 42 to drive the material that forms the end 42 into the first cavity 50 to thereby fill the first cavity 50 to form a second intermediate workpiece 60. In the example provided, the first cavity 50 has a diameter of 74.0 mm. While the end 42' of second intermediate workpiece 60 is illustrated to be cylindrically shaped, those of skill in the art will appreciate that it could be formed in various different ways. For example, the end 42' of the second intermediate workpiece 60 could be formed in a frustoconical shape that facilitates the gathering of material for a subsequent upsetting operation (e.g., a second pass)

Figure 5:
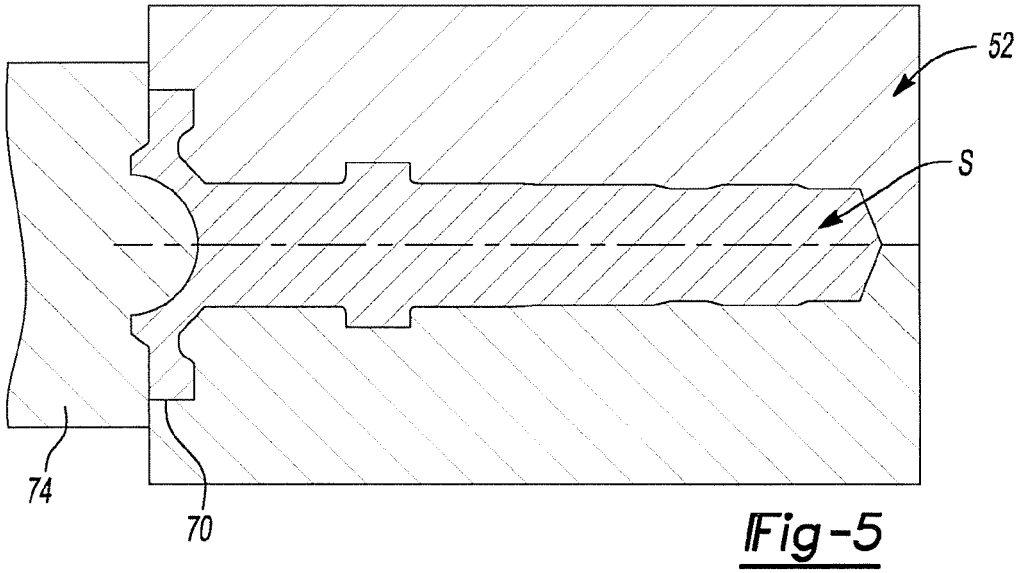
FIG. 5 is a section view taken through a second upset forging tool and the stepped shaft of FIG. 2.
Figure 6:
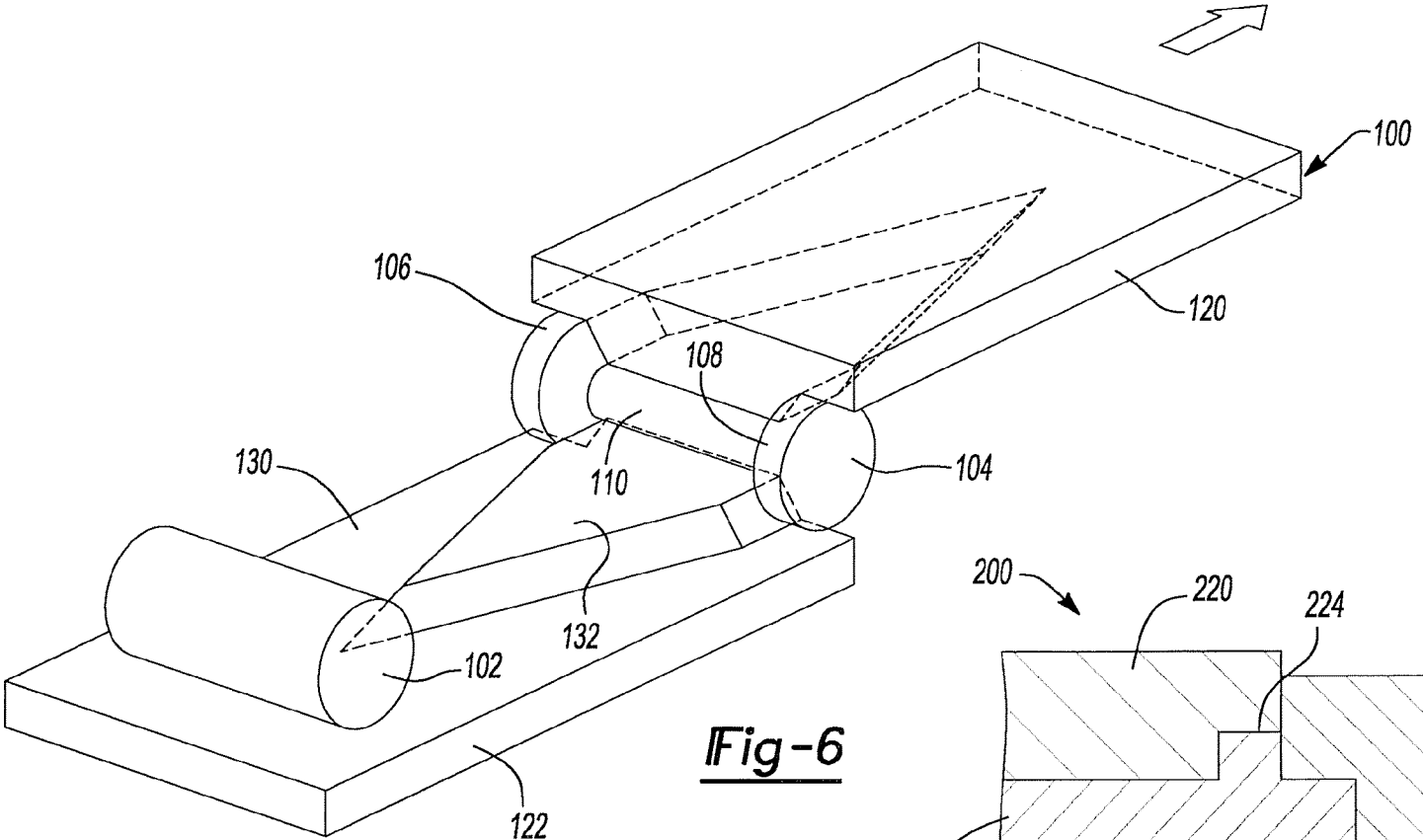
FIG. 6 is a schematic representation of a tooling set for forming a shaft in a conventional cross-wedge rolling operation.
Figure 7:
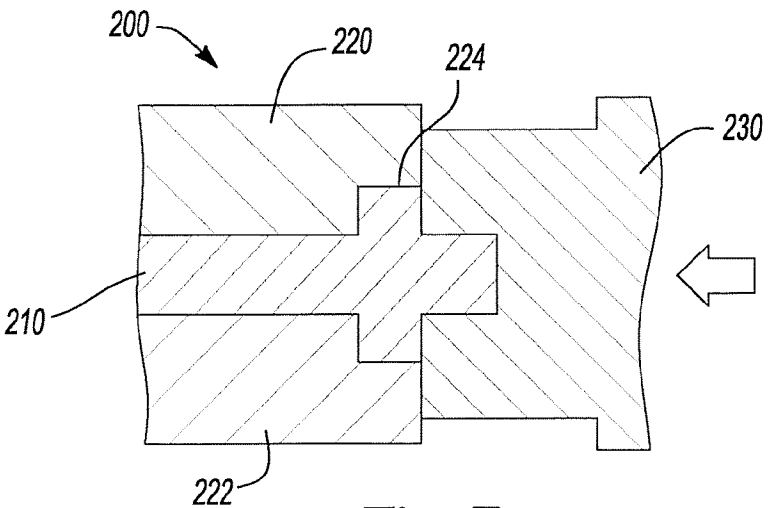
FIG. 7 is a schematic representation of a tooling set for forming a shaft in a conventional upset forging operation.

With reference to FIGS. 1 and 5, the second intermediate workpieces 60 can be indexed into a second cavity or pass 70 in the tooling set 52. A portion of the end 42' (FIG. 4) of the second intermediate workpiece 60 can extend from the tooling set 52 and a second ram 74 can be pressed against the end 42' to drive the material that forms the end 42' into the second cavity 70 to thereby fill the second cavity 70 to form the stepped shaft S.

With specific reference to FIG. 2, it will be appreciated that as a combination of cross-wedge rolling and upsetting is employed to form the stepped shaft S, the geometry of the stepped shaft S can include features that cannot be solely obtained through either cross-wedge rolling or upset forging. For example, the first cylindrical portion CP1 of the exemplary stepped shaft S includes a first axial end E1 and a second axial end E2 that are contoured in a predetermined manner that cannot be obtained solely through cross-wedge rolling. In the example provided, the first axial end E1 includes a first recess R1 having a first concave surface CS1, while the second axial end E2 includes a second recess R2 having a second concave surface CS2. The first and second recesses R1 and R2 can be configured to reduce the mass of the stepped shaft S (relative to a similar stepped shaft formed solely through cross-wedge rolling). The first recess R1 is also configured to aid in driving the material that forms the first cylindrical portion CP1 in a radially outward direction during the upset forging process. It will be appreciated that as material is being driven in a radially outward direction during the upset forging process, various features, such as gear teeth GT, can be formed into the circumference of the first cylindrical portion CP1 during the upset forging process.

Figure 8:
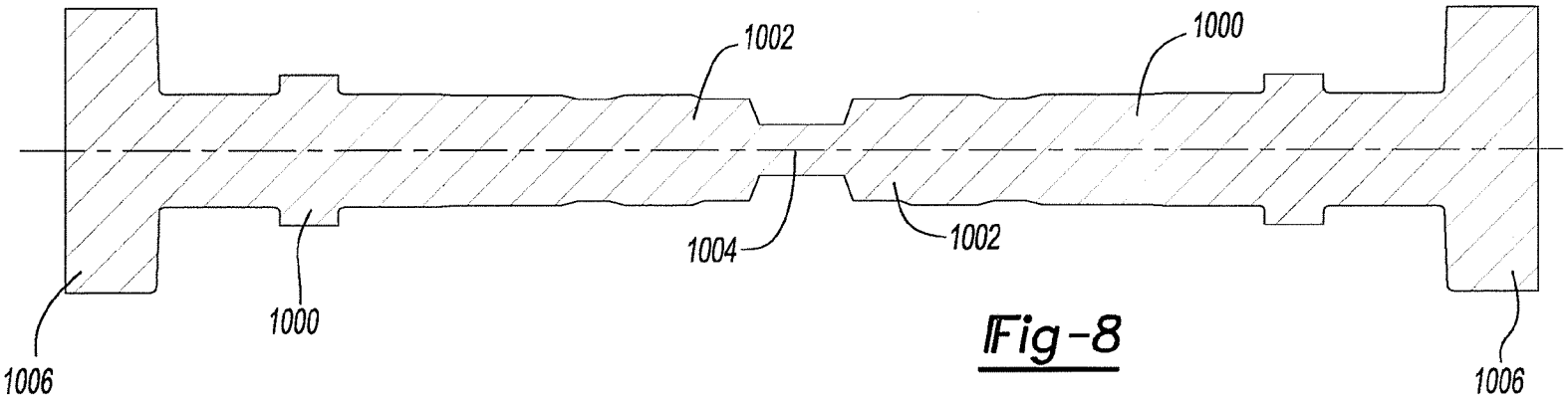
FIG. 8 is a sectional view of a pair of workpieces constructed in a prior art cross-wedge rolling operation in which the two workpieces are coupled to one another at their small ends.
Figure 9:
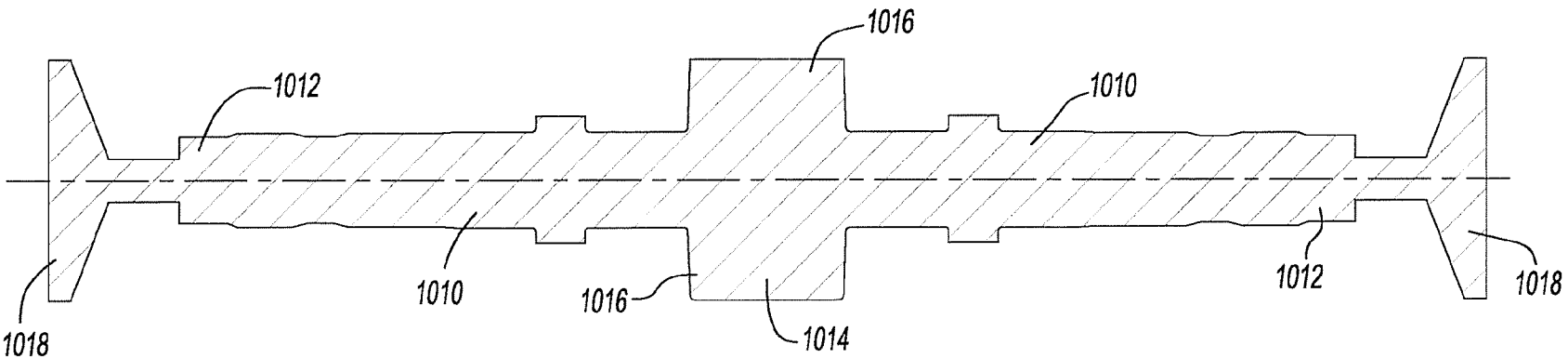
FIG. 9 is a sectional view of a pair of workpieces constructed in a prior art cross-wedge rolling operation in which the two workpieces are coupled to one another at their large ends.

FIGS. 8 and 9 illustrate workpieces having profiles that could be achieved only through cross wedge rolling. In the example of FIG. 8, two workpieces 1000 are formed such that their small ends 1002 are interconnected by a nib 1004. While the nib 1004 can be removed during the cross wedge rolling operation, the material that forms the nib 1004 is handled as waste material. Moreover, it will be appreciated that the large ends 1006 may need to be formed longer than desired so as to prevent the axially outward ends of the large ends 1006 from deflecting outwardly (i.e., to prevent dishing of the axially outward ends). In the example of FIG. 9, two workpieces 1010 are formed such that their large ends 1016 are interconnected by a nib 1014 and sections of waste material 1018 are connected to their small ends 1012. This nib 1014 and the waste material 1018 are not removed during the cross-wedge rolling operation and as such, sawing can be employed to remove a portion of the waste material 1018 and to separate the two workpieces. Additionally, the workpieces 1010 can be processed in one or more turning operations to true the large end 1016 and/or the small end 1012. It will be appreciated that both workpieces 1000, 1010 have additional material that would have to be removed via machining to achieve an exterior longitudinally extending surface that is similar to that of the stepped shaft S of Figure. It will also be appreciated that such machining operation adds significant cost to the product, as well as generates significant amounts of waste material.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A method for forming a stepped shaft, the method comprising:

providing a billet of a predetermined mass;

heating the billet;

cross-wedge rolling the billet to form an intermediate workpiece about a shaft axis having a first cylindrical portion and a second cylindrical portion that are axially spaced apart along the shaft axis by a neck that is smaller in diameter than the first and second cylindrical portions, the first and second cylindrical portions having first and second exterior surfaces, respectively, that are disposed concentrically about the shaft axis; and performing at least one upset forging operation on the end of the intermediate workpiece to enlarge the first cylindrical portion such that in at least one location its diameter is larger than a diameter of any other portion of the stepped shaft and larger than a diameter of the billet, wherein the second cylindrical portion is substantially unchanged by the at least one upset forging operation, wherein the at least one location is cylindrically shaped and wherein the diameter of the at least one location and the second exterior surface are disposed concentrically about the shaft axis, and wherein a plurality of teeth are formed around a circumference of the first cylindrical portion during the at least one upset forging operation.

2. The method of claim 1, wherein a recess is formed into an axial end of the stepped shaft during the at least one forging operation.

3. The method of claim 2, wherein the recess includes a concave surface.

4. The method of claim 1, wherein the billet is heated to a temperature above 1200° F.

5. The method of claim 4, wherein the temperature is above 2000° F.

6. The method of claim 5, wherein the temperature is about 2250° F.

7. The method of claim 1, wherein the intermediate workpiece is not reheated prior to the at least one upset forging operation.

8. A method for forming a stepped shaft, the method comprising:

providing a billet of a predetermined mass;

heating the billet;

rolling the billet to reduce a diameter of the billet in at least two areas to form at least three zones, each of the zones having a diameter that is different from any adjacent zone or zones;

upset forging a first one of the zones to form a first portion of the stepped shaft, the first one of the zones being enlarged in diameter and reduced in length such that a diameter of the first portion of the stepped shaft is greater than a diameter of the billet; and forming a plurality of teeth about the first portion of the stepped shaft;

wherein a second one of the zones is disposed between the first portion of the stepped shaft and a third one of the zones and wherein a diameter of the second one of the zones is smaller than a diameter of a third one of the zones.

9. The method of claim 8, wherein the second one of the zones is adjacent to both the first portion of the stepped shaft and the third one of the zones.

10. The method of claim 8, wherein a first recess is formed into a first axial end of the first portion of the stepped shaft.

11. The method of claim 10, wherein the first recess includes a concave surface.

12. The method of claim 10, wherein a second recess is formed into a second axial end of the first portion of the stepped shaft.

13. The method of Claim 8, wherein the plurality of teeth is formed when the first one of the zones is upset forged.

14. The method of claim 8, wherein the billet is heated to a temperature above 1200° F.

15. The method of claim 14, wherein the temperature is above 2200° F.

16. The method of claim 15, wherein the temperature is about 2250° F.

17. A method for forming a stepped shaft, the method comprising:

providing a billet of a predetermined mass;

heating the billet to a temperature of about 2250° F.;

rolling the billet to reduce a diameter of the billet in at least two areas to form at least three zones, each of the zones having a diameter that is different from any adjacent zone or zones; and upset forging a first one of the zones to form a first portion of the stepped shaft, the first one of the zones being enlarged in diameter and reduced in length such that a diameter of the first portion of the stepped shaft is greater than a diameter of the billet;

wherein a second one of the zones is disposed between the first portion of the stepped shaft and a third one of the zones and wherein a diameter of the second one of the zones is smaller than a diameter of a third one of the zones, wherein the second one of the zones is adjacent to both the first portion of the stepped shaft and the third one of the zones, wherein a first recess is formed into a first axial end of the first portion of the stepped shaft, wherein the first recess includes a concave surface, wherein a second recess is formed into a second axial end of the first portion of the stepped shaft, wherein a plurality of teeth about the first portion of the stepped shaft when the first one of the zones is upset forged, and wherein the intermediate workpiece is not reheated prior to the at least one upset forging operation.

* * * * *